United States Patent [19]

Goodman et al.

[11] 4,286,834

[45] Sep. 1, 1981

[54] INTERCONNECTION SYSTEM

[75] Inventors: David S. Goodman, Mission Viejo; Gerald J. Selvin, Huntington Beach, both of Calif.; Edward G. Dubell, Phoenix, Ariz.; Donald J. Doty, El Toro, Calif.; Alfred R. Erbe, Phoenix, Ariz.; Robert E. Wilson, Ventura, Calif.

[73] Assignee: International Telephone and Telegraph Corporation, New York, N.Y.

[21] Appl. No.: 93,303

[22] Filed: Nov. 13, 1979

[51] Int. Cl.[3] ..... H01R 13/629

[52] U.S. Cl. ..... 339/16 R; 339/45 M; 339/91 R

[58] Field of Search ..... 339/15, 16 R, 45 R, 339/45 M, 75 R, 75 M, 91 R

[56] References Cited

U.S. PATENT DOCUMENTS

| | | | |
|---|---|---|---|
| 3,156,513 | 11/1969 | Peterson et al. | 339/45 M |
| 3,159,444 | 12/1969 | Stine | 339/45 M |
| 3,336,562 | 8/1967 | McCormick et al. | 339/45 M |

*Primary Examiner*—Eugene F. Desmond

*Attorney, Agent, or Firm*—Thomas L. Peterson

[57] ABSTRACT

An interconnection system for coupling electrical and air pressurized conductors carried by an aircraft wing and a missile pylon mounted on the wing. The interconnection system provides a rapidly releasable positive lock between the pylon and the wing.

4 Claims, 8 Drawing Figures

INTERCONNECTION SYSTEM

The Government has rights in this invention pursuant to Contract No. F33657-78-C-0108 awarded by the Department of the Air Force.

BACKGROUND OF THE INVENTION

The present invention relates to an interconnection system and, more particularly, to a quick disconnect umbilical type of connection arrangement for mounting plates carrying a plurality of mating electrical and fluid connector means.

For aircraft carrying wing missiles, it is necessary to provide an interconnection between the electrical controls in the aircraft and the missile as well as air conditioning lines to maintain the interior of the missile at a desired temperature. This requires the use of an interconnection arrangement between the aircraft wing and missile pylon which may be rapidly released when the pylon is dropped. It has been found that a problem exists in such an interconnection arrangement due to high differential pressures which develop between the air valve coupling elements in the interconnection assembly between the pylon and the wing which are part of the pressurized air conditioning conducting line between the aircraft and the missile. Such differential pressures may reach magnitudes sufficient to cause the mating electrical connectors in the wing and pylon of the interconnection system to separate. It is the purpose of the present invention to provide a releasable locking arrangement for the connector and air valve mounting plates of such an interconnection system to avoid untimely separation thereof.

The following United States patents disclose prior art releasable locking arrangements for electrical connectors per se which are pertinent to the present invention: U.S. Pat. No. 3,156,513; U.S. Pat. No. 3,335,391, and U.S. Pat. No. 3,452,316.

SUMMARY OF THE INVENTION

According to the principal aspect of the present invention, there is provided an interconnection system for coupling electrical and fluid conductors carried, for example, by an aircraft and a pylon therefor. The system comprises a first mounting plate adapted to be fixedly connected to the aircraft. The first mounting plate carries at least one electrical connector member and a fluid coupling element. A mounting plate assembly is provided which is adapted to be carried by a pylon that is releasably mounted on the aircraft over the first mounting plate. The assembly includes a front plate and a rear mounting plate. The rear plate is movable from a rear position to a forward position closer to the front plate. The front plate carries at least one electrical connector member and fluid coupling element arranged to mate with the electrical connector member and fluid coupling element on the first mounting plate. Means biases the rear plate toward its rear position. The rear plate is adapted to be fixed to the pylon whereby, when the pylon is moved forwardly for attachment to the aircraft, during an initial stage of movement of the pylon, and hence the rear plate, the electrical connector member and fluid coupling element on the front plate will mate with the electrical connector member and fluid coupling element on the first mounting plate. During a second further stage of movement of the pylon, the rear plate will reach its forward position. Rapidly releasable positive retaining means is provided for the first mounting plate and the mounting plate assembly for locking the electrical connector members and fluid coupling elements in mated relationship against the separating force of high differential pressure which may exist between the fluid coupling elements. The retaining means comprising a catch carried by the front plate, a lock member on the rear plate and a spring lock element fixed to the first mounting plate. The spring lock element is normally biased to a release position with respect to the catch. During the initial stage of movement of the pylon toward the aircraft, the catch moves to an overlapping but spaced apart position relative to the lock element. During the second stage of movement, the lock member moves forwardly relative to the front plate and the lock element to shift the lock element into locking position with the catch.

Thus, the electrical connector members and fluid coupling elements on the respective mounting plates of the pylon and aircraft will first engage and, thereafter, the mounting plate assemblies will be positively locked to prevent separation of the electrical connectors even if a high pressure differential is developed between the fluid conductors. Upon release of the pylon from the aicraft, the positive locking arrangement will initially disengage thus allowing the electrical connector members and fluid coupling elements on the two mounting plate assemblies to disconnect as the pylon falls free from the aircraft.

DESCRIPTION OF THE PREFERRED EMBODIMENT

Figure 1:
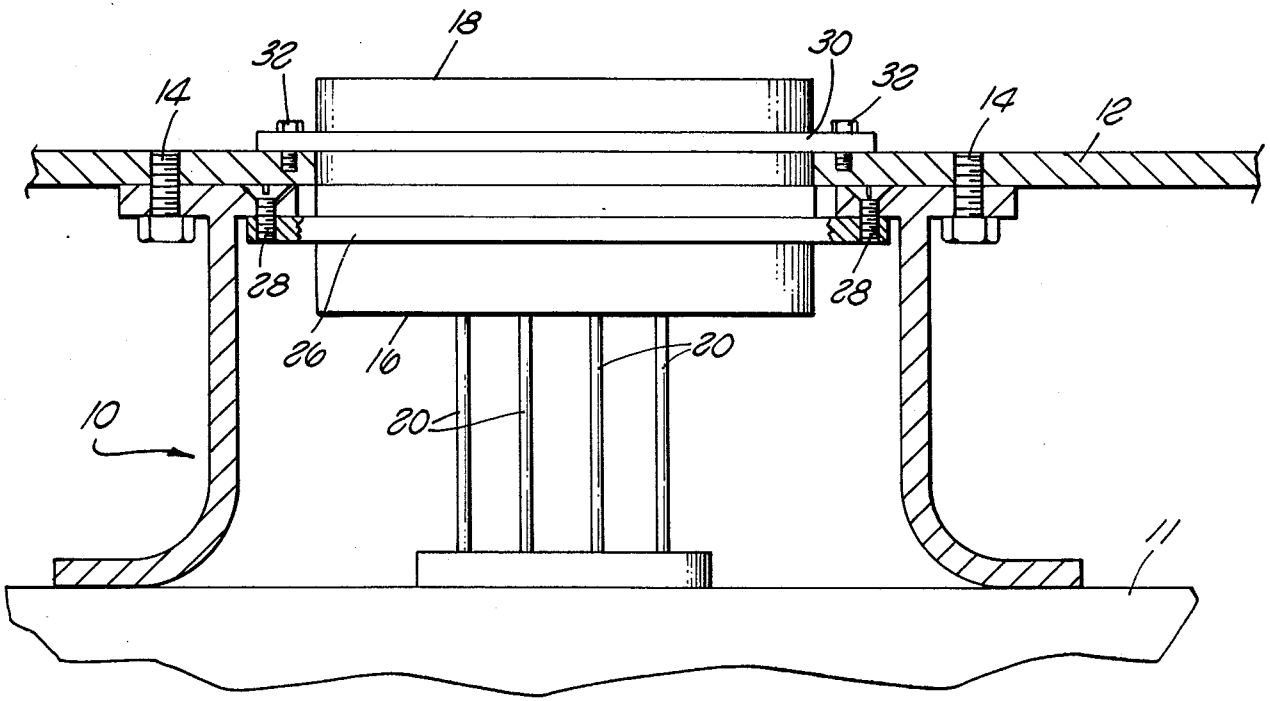
FIG. 1 is a somewhat schematic illustration of a missile pylon connected to an aircraft wing incorporating the interconnection system of the present invention.
Figure 2:
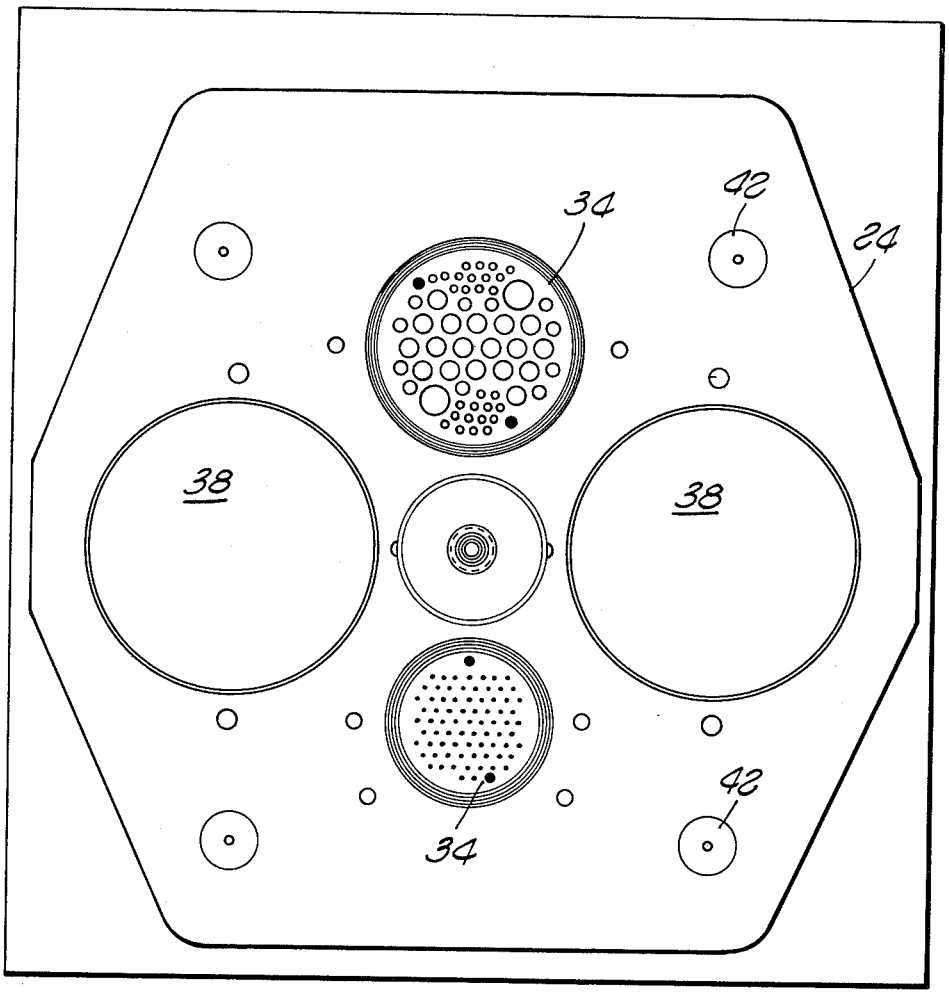
FIG. 2 is a front view of the front mounting plate of the plug mounting plate assembly of the interconnection system illustrated in FIG. 1.

Referring now to the drawings in detail, FIG. 1 schematically illustrates a pylon 10 of a missile 11 connected to the wing 12 of an aircraft by means of rapidly releasable fastening means, such as explosive bolts 14. The pylon carries a plug mounting plate assembly, generally designated 16, which is interconnectable with a receptacle mounting plate assembly, generally designated 18, fixedly mounted on the wing 12. The conduits 20 extending from the plug assembly 16 through the pylon 10 to the missile represent electrical conductor lines and air conditioning flow lines which are coupled to the electrical connector members and fluid coupling elements, respectively, mounted in the assembly 16.

Reference is now made to FIGS. 2 to 6 which illustrate the specific structure of the plug and receptacle mounting plate assemblies 16 and 18. The assembly 16 comprises a front mounting plate 24 and a rear mounting plate 26. As seen in FIG. 1, the rear plate 26 is fixedly connected to the pylon 10 by screws 28. The receptacle mounting plate assembly 18 includes a single mounting plate 30 which, as seen in FIG. 1, is fixedly connected to the wing 12 by screws 32. A plurality of electrical plug connector members 34, two being shown by way of example only, are mounted on the front plate 24 of the assembly 16. Two electrical receptacle connector members 36 are mounted in the plate 30 of the assembly 18 in position to be mated with connector members 34 when the pylon 10 is mounted on the wing 12. It will be appreciated, of course, that the receptacle connector members could be mounted in the assembly 16 and the plug connector members mounted in the assembly 18, if desired.

Two fluid conducting elements 38 are mounted on the front plate 24 of assembly 16 which couple with fluid conducting elements 40 on the plate 30 when the assemblies 16 and 18 are interconnected. Each pair of mating coupling elements 38, 40, contains a valve, not shown, controlling pressurized air flowing in the air conditioning conduit leading between the aircraft and missile pylon 10. Each valve is constructed so that it will be opened when the coupling elements 38 and 40 are interconnected. Four guide pins 42 are mounted on the front plate 24 of the assembly 16. The guide pins engage in guide sleeves 44 mounted on the rear of the plate 30 of the assembly 18 to assure proper alignment and coupling of the electrical connector members and fluid coupling elements.

Figure 7:
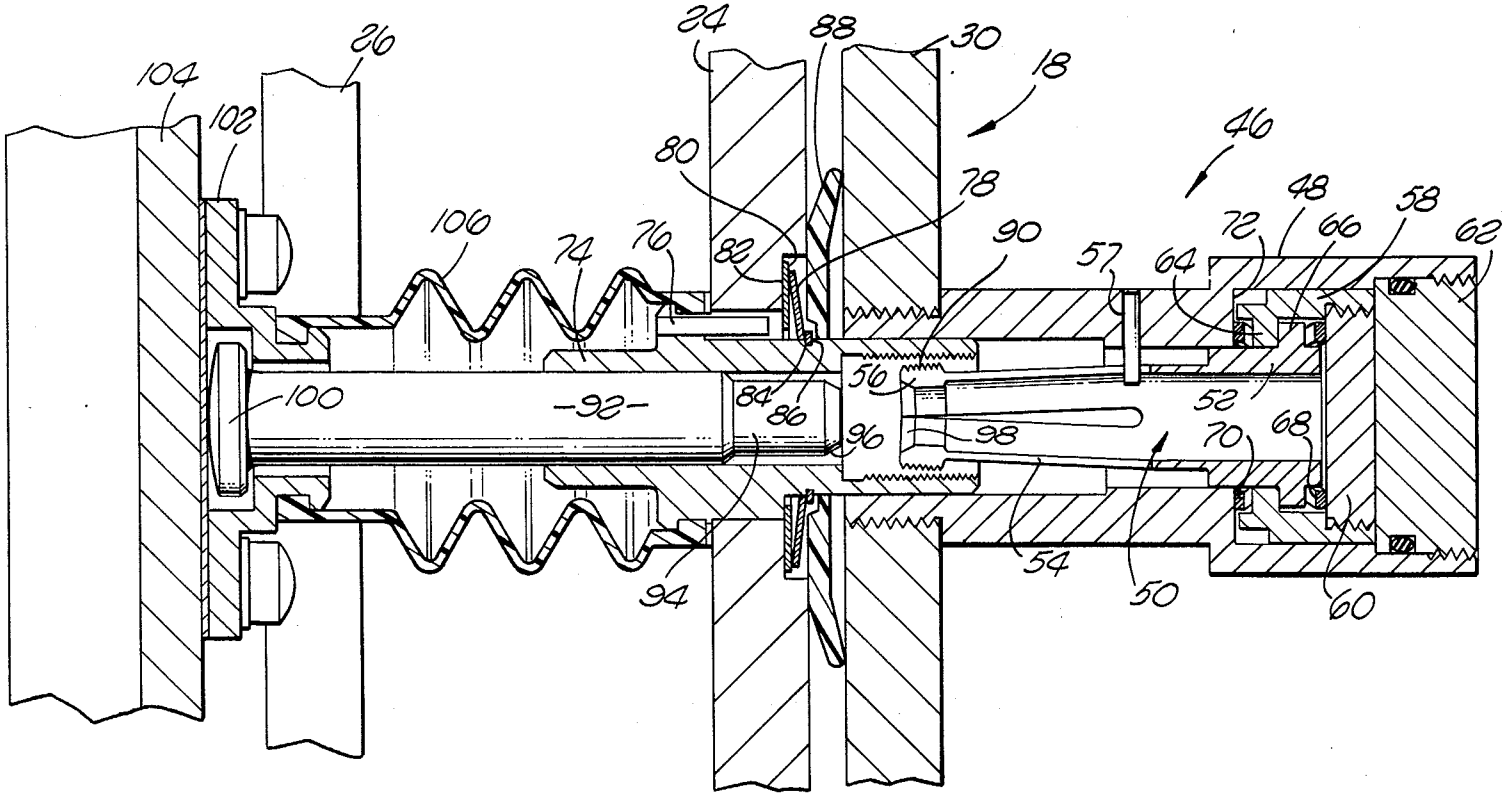
FIG. 7 is an enlarged, fragmentary, partial sectional view showing the locking arrangement of the mounting plate assemblies illustrated in FIG. 5 in greater detail.
Figure 8:
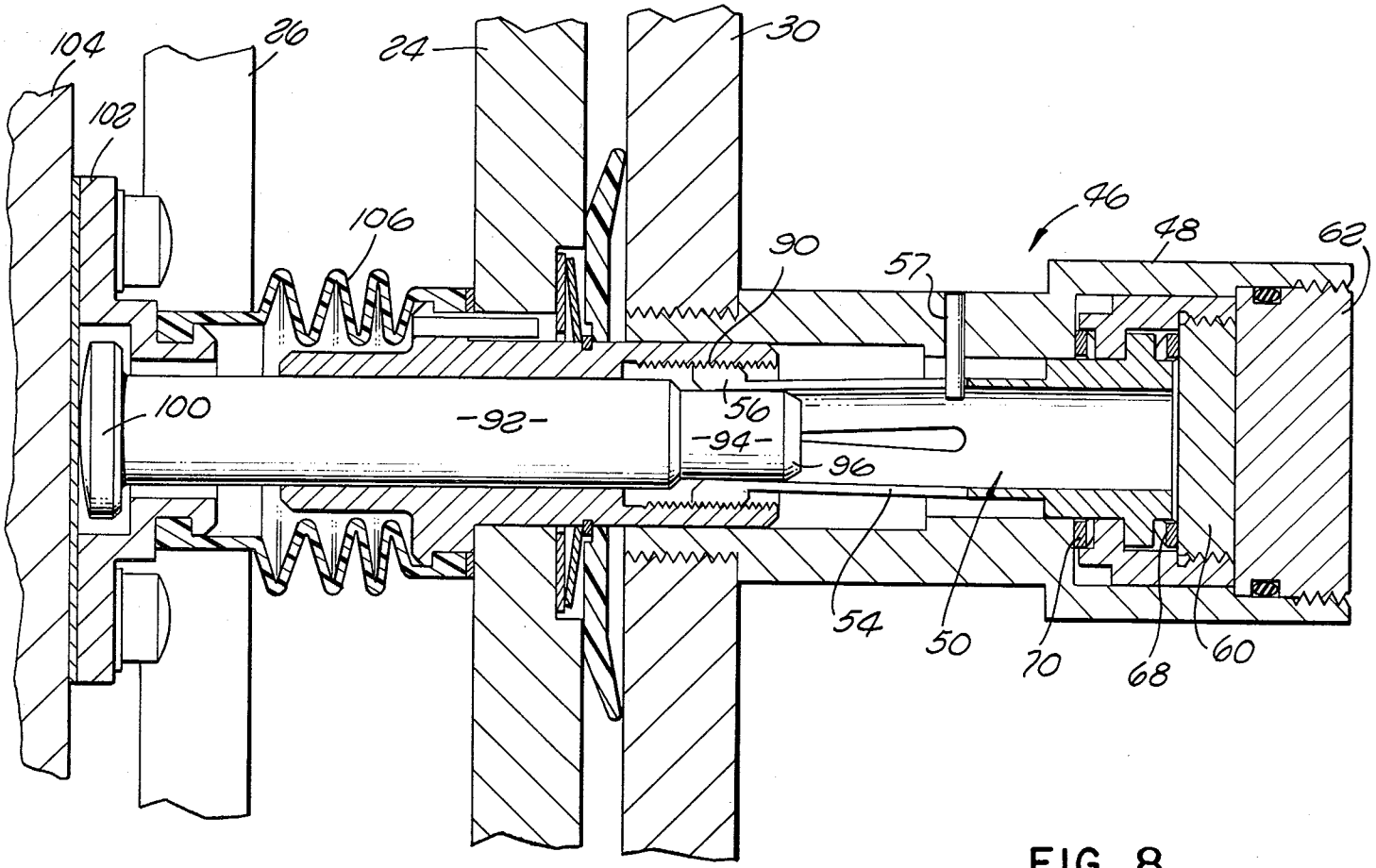
FIG. 8 is a partial sectional view similar to FIG. 7 but showing the mounting plate assemblies in their final locked condition.

The rapidly releasable locking mechanism for the assembly 16 and 18 is generally designated 46 and is best seen in FIGS. 7 and 8. Referring first to FIG. 7, the portion of the locking mechanism which is mounted on the receptacle mounting plate assembly 18 comprises a housing 48 fixed to and extending rearwardly from the mounting plate 30. The housing 48 is located approximately in the center of the electrical connector members and fluid coupling elements on the plate 30. A tang assembly 50 in the housing comprises a ring 52 having four longitudinally forwardly extending spring tangs 54 thereon which are externally threaded at their forward ends 56. The assembly 50 is fixed against rotation in the housing by a locking pin 57. A sleeve 58 surrounds the ring 52 and is threadedly engaged at its rear to a spacer 60. A retaining plug 62 is threaded into the rear of the housing 58 to retain the tang assembly 50, sleeve 58 and spacer 60 therein. The sleeve 58 has an inwardly extending annular flange 64 positioned in front of an outwardly extending annular flange 66 on the ring 52. A wave spring 68 is disposed between flange 66 and spacer 60 and a second wave spring 70 is positioned between the flange 64 and a rearwardly facing shoulder 72 on the interior of the housing.

The portion of the locking mechanism 46 which is mounted on the assembly 16 comprises a retainer sleeve 74 mounted on the front plate 24 in a position to enter the housing 48 on the plate 30 when the assemblies 16 and 18 are interconnected. The retainer sleeve 74 is fixed against rotation in plate 24 by a locking pin 76. The sleeve 74 is resiliently axially retained in the plate 24 by means of a Bellville spring 78 which bears against a washer 80 mounted in a recess 82 in the front face of the plate 24. The inside of the spring 78 bears against a retaining ring 84 mounted in a groove 86 in the outer surface of the sleeve 74. A seal 88 surrounds the sleeve 74 in front of the plate 24. The forward end of the sleeve 74 extends beyond the front of the plate 24 a distance sufficient to allow it to enter into the interior of the housing 48 so as to surround the forward ends 56 of the tangs 54 when the assemblies 16 and 18 are interconnected, as seen in FIG. 7. The interior 90 of the sleeve 74 is threaded, to provide a catch which is engageable by the threaded tangs 54 when the tangs are deflected outwardly. A shaft 92 is axially slidable in the sleeve 74. The forward end 94 of the shaft has a reduced diameter with a beveled forward edge 96 which is engageable with beveled interior surfaces 98 on the tangs 54 so that when the shaft 92 is shifted forwardly, the shaft will cam the spring tangs 54 outwardly to engage the internally threaded retainer sleeve 74. The rear of shaft 92 is formed with a head 100 which is mounted within a retainer 102 fixed to the center of a spider plate 104 behind the rear plate 26 of the assembly 16. A rubber bellows seal 106 surrounding the sleeve 74 and shaft 92 is connected at its forward end to the sleeve and at its rear end to the retainer 102.

Figure 3:
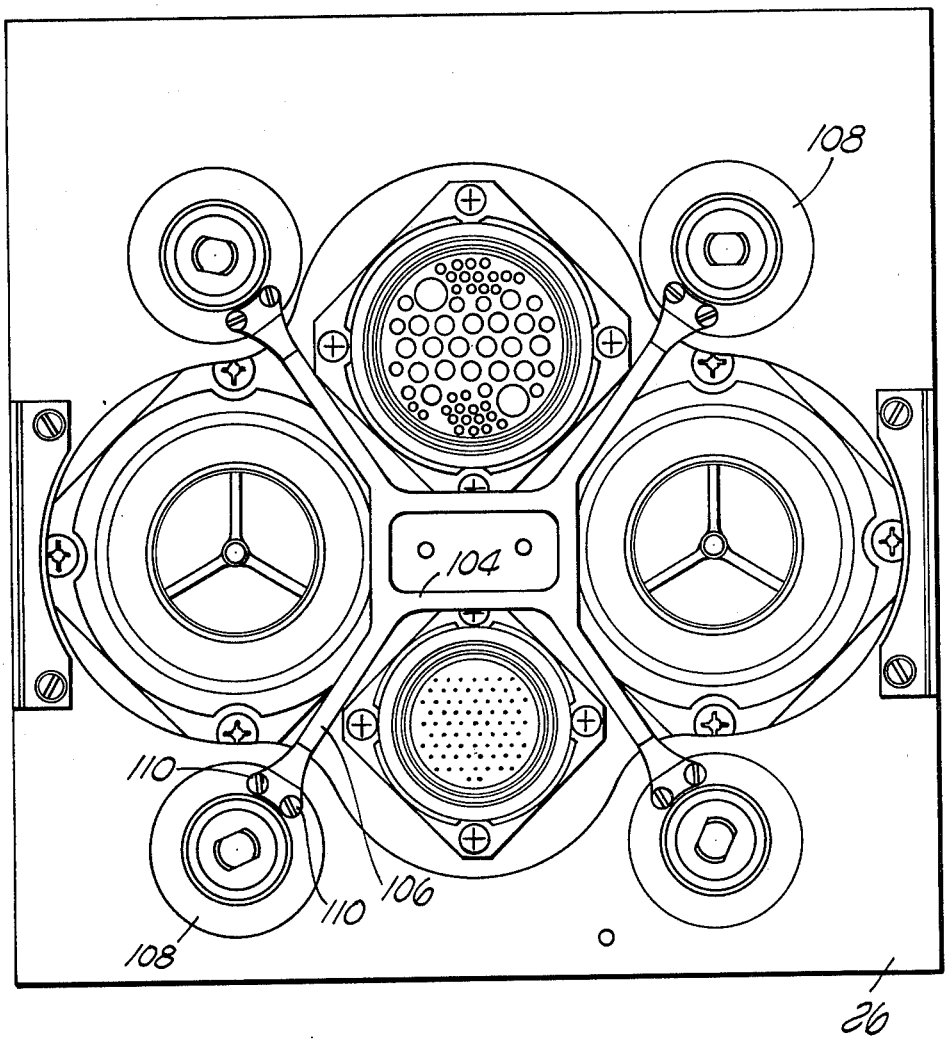
FIG. 3 is a rear view of the plug mounting plate assembly showing the rear plate thereof.
Figure 4:
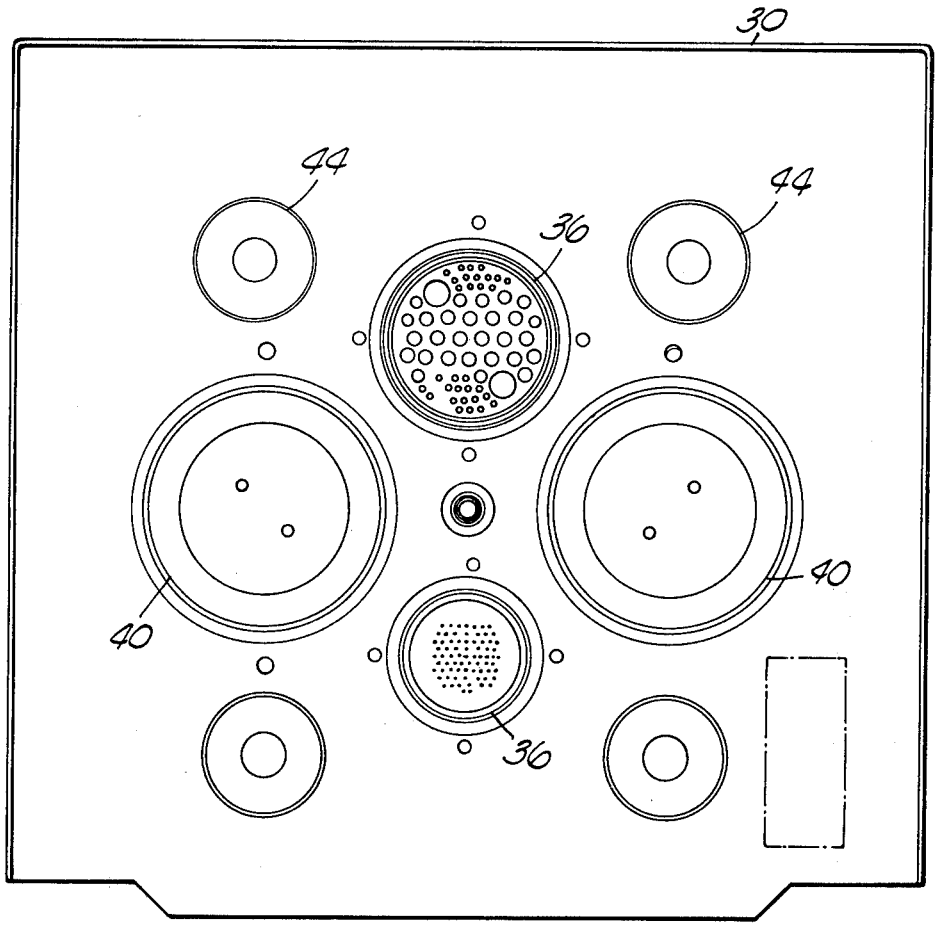
FIG. 4 is a front view of the receptacle mounting plate assembly of the interconnection system.
Figure 5:
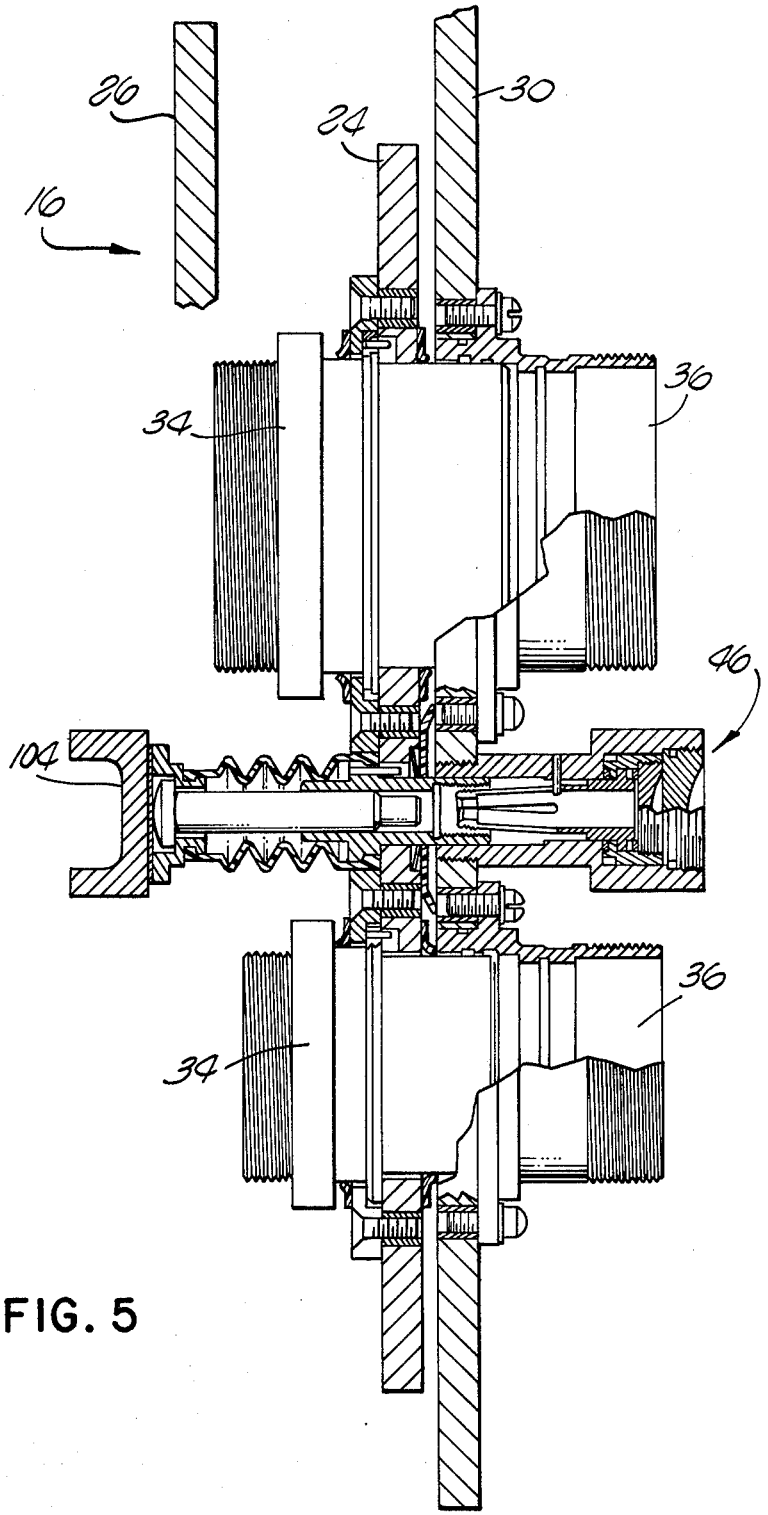
FIG. 5 is a transverse partial sectional view through the interconnection system showing the rear mounting plate of the plug mounting plate assembly in an initial position with the plug connector members thereon mated with receptacle connector members of the receptacle mounting assembly, but prior to locking of the assembly.
Figure 6:
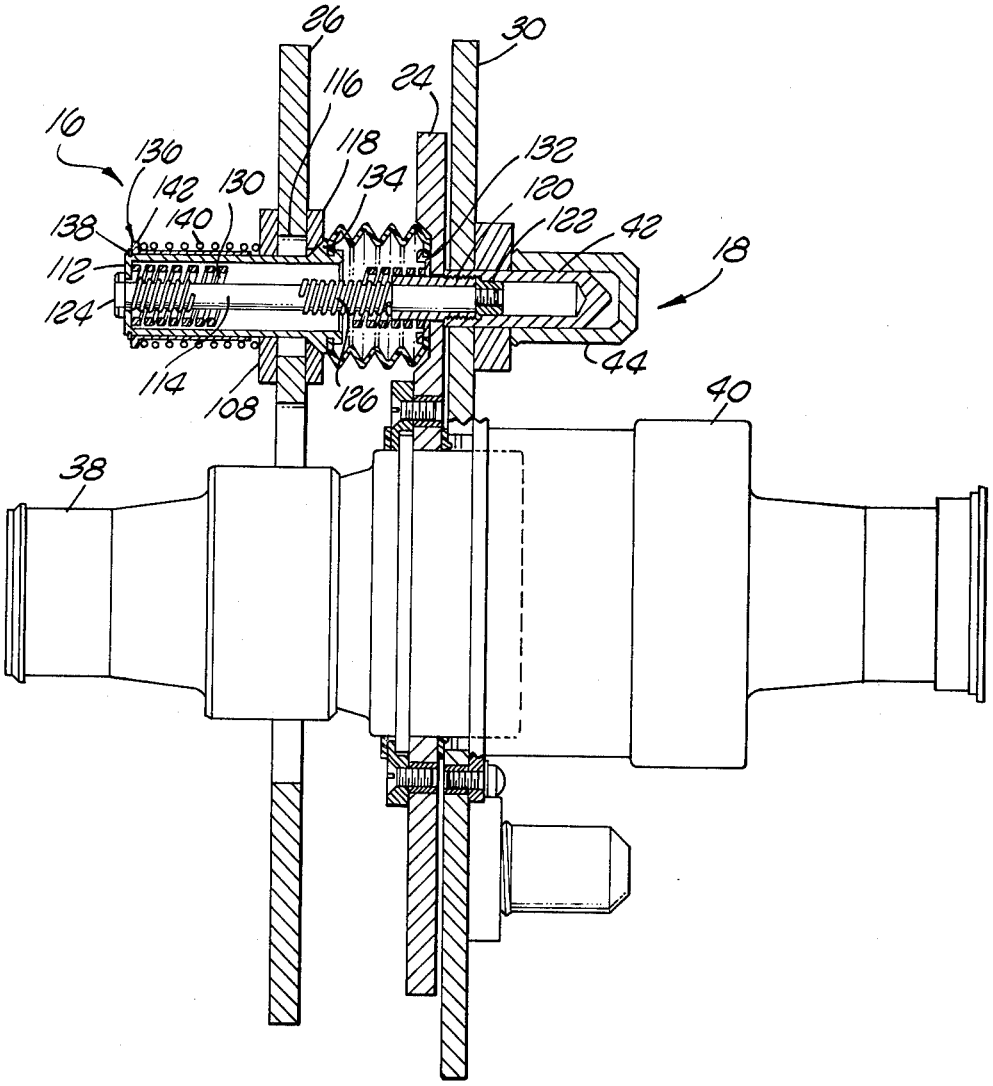
FIG. 6 is a transverse partial sectional view through the interconnection system showing the rear mounting plate of the plug mounting plate assembly in its initial position and the air valves of the assemblies mated.

As seen in FIG. 3, the spider plate 104 embodies four outwardly extending legs 106 each connected to a washer 108 by screws 110. Each washer 108 surrounds a spring housing 112 which in turn surrounds a rod 114. The housing extends forwardly through an opening 116 in the plate 26 which has a diameter somewhat greater than that of the housing, as best seen in FIG. 6. A second washer 118 is located in front of the plate 26 surrounding the housing 112. The forward end of the rod 114 is fixed to the hollow guide pin 42 by means of a threaded sleeve 120 and nut 122. The rear end of the rod 114 extends through an opening in the rear of the housing 112. The head 124 on the rear of the rod 114 bears against the rear wall of the housing. A first coil spring 126 surrounds the rod 114 and extends from the sleeve 120 to the rear wall of the housing while a second coil spring 130 extends from an outwardly extending annular flange 132 on the sleeve 120 to the rear of the housing. The forward end of the housing 112 embodies an outwardly extending tapered flange 134 which bears against the front of the washer 118. Thus, the springs 126 and 130 act between the front plate 30 and the housing 112 to bias the rear plate 26 rearwardly to a normal rear position relative to the front plate 24 when the pylon 10 is unconnected to the wing 12 of the aircraft. The springs also urge the washers 108 and, hence, the spider plate 104 and lock shaft 92 to a rearward position relative to the front plate and the tangs 54 on the receptacle mounting plate assembly 18 as seen in FIG. 7. A sleeve 136 surrounds the housing 112 and is retained thereon by a retaining ring 138. A spring 140 surrounding the sleeve 136 extends from a rear flange 142 thereon to the washer 108 to maintain the washer in engagement with the rear of the plate 26. A bellows seal 144 surrounds the rod 114 and springs 126 and 130 between the front plate 24 and housing 112.

By virtue of the aforementioned mounting arrangement between the plates 24 and 26 of the assembly 16 using the washers 108 and 118 and the housing 112 which is substantially undersized relative to the opening 116 in plate 26, the plate 26 is free to float laterally relative to the front plate 24 to accommodate tolerances between the pylon 16 and wing 12 and angular misalignment therebetween.

The operation of the invention is as follows:

When the pylon 10 is initially moved into position for mounting on the wing 12, the guide pins 42 on the assembly 16 enter into the guide sleeves 44 on the assembly 18 for positive alignment of the front plate 24 with respect to the mounting plate 30. During this initial stage of movement of the pylon over the receptacle mounting assembly 18, the plug connector members 34 mounted on the plate 24 will mate with the receptacle connector members 36 on the plate 30 and the retainer sleeve 74 of the locking mechanism 46 will enter the housing 48 assuming the position illustrated in FIG. 7. At this time, the seal 88 on the front plate 24 of assembly 16 is deflected by engagement with the plate 30 on assembly 18 and coupling of the air coupling elements 38 and 40 is achieved, thus opening the valves therein.

Continued motion of the pylon toward the wing for final securement by the explosive bolts 14 results in the rear plate 26 of the plug mounting plate assembly 16 moving forwardly relative to the front plate 24 thereof until it reaches the final forward position as illustrated in FIG. 8. During this second stage of movement of the pylon, and thus the rear plate 26, the springs 126 and 130 are compressed and the spider plate 104 moves forwardly together with the rear plate 26 causing the shaft 92 to slide forwardly in the retainer 74 until it engages tangs 54, deflecting the tangs radially outward until the external threads thereon engage the internal threads 90 on the sleeve 74 thereby positively locking the two assemblies 16 and 18 together. The resilient axial mounting of the tang ring 52 by the wave springs 68 and 70 and of the retainer sleeve 74 by the Bellville washer 78 eliminates any mis-matching of the mating threads on the tangs and the retainer. The lateral floating mounting arrangement provided between the spider plate 104 and the rear plate 26 assures that the pylon may be properly positioned for mounting on the wing 12 by the bolts 14 after the electrical connector members and fluid coupling elements are connected in spite of tolerances between the pylon and the wing.

When the explosive bolts 14 are energized to release the pylon from the wing 12, the rear plate 26 will shift rearwardly relative to the front plate 24, since the rear plate is coupled to the pylon and because of the force of springs 126 and 130. Rearward movement of the rear plate and, hence, the spider plate 104 will cause the shaft 92 to withdraw from the tangs 54 to release the locking mechanism 46, whereupon the electrical connector members and fluid coupling elements are safely and automatically disengaged as the missile falls away from the wing.

It will, therefore, be appreciated that the interconnection system of the present invention provides automatic and failsafe locking and unlocking of the assemblies 16 and 18 and, hence, coupling and uncoupling of the electrical connector members and fluid coupling elements thereon.

What is claimed is:

1. An interconnection system for coupling electrical and fluid conductors carried, for example, by an aircraft and a pylon therefor comprising:

a first mounting plate adapted to be fixedly connected to an aircraft and carrying at least one electrical connector member and fluid coupling element;

a mounting plate assembly adapted to be carried by a pylon which is releasably mounted on the aircraft over said first mounting plate, said assembly including a front plate and a rear mounting plate, said rear plate being movable from a rear position to a forward position closer to said front plate;

said front plate carrying at least one electrical connector member and fluid coupling element arranged to mate with the electrical connector member and fluid coupling element on said first mounting plate;

means biasing said rear plate toward said rear position;

said rear plate being adapted to be fixed to the pylon whereby, when the pylon is being moved forwardly for attachment to the aircraft, during an initial stage of movement of the pylon, and hence the rear plate, the electrical connector member and fluid coupling element on said front mounting plate will mate with the electrical connector member and fluid coupling element on said first mounting plate and, during a second further stage of movement, said rear plate will reach said forward position;

rapidly releasable positive retaining means for said first mounting plate and said mounting plate assembly for locking said electrical connector members and fluid coupling elements in mated relationship against the separating force of high differential pressures which may exist between said fluid coupling elements;

said retaining means comprising a catch carried by said front plate, a lock member on said rear plate and a spring lock element fixed to said first mounting plate, said spring lock element being normally biased to a release position with respect to said catch; and during said initial stage of movement of the pylon toward the aircraft, said catch moving to an overlapping, but spaced apart position relative to said lock element, and during said second stage of movement, said lock member moving forwardly relative to said front plate and said lock element to shift said lock element into locking position with said catch.

2. An interconnection system as set forth in claim 1 wherein:

said catch comprises an internally threaded sleeve;

said spring lock element comprises a circular series of longitudinally extending tangs externally threaded at their forward ends; and said lock member comprises a shaft axially slidable in said sleeve and movable into the interior of said series of tangs camming said ends into engagement with said internally threaded sleeve during said second stage of movement of said rear plate.

3. An interconnection system as set forth in claim 1 wherein:

said biasing means comprises a spring interposed between said front and rear plates.

4. An interconnection system as set forth in claim 1 wherein:

a spider plate is located behind said rear plate;

said spider plate having a central portion and a plurality of legs extending outwardly therefrom;

means providing a lateral floating connection between the ends of said legs and said rear plate; and said lock member being connected to said central portion of said spider plate.

* * * * *